United States Patent [19]

Boschetti

[11] 4,372,094

[45] Feb. 8, 1983

[54] PROCESS FOR SIMPLE, RAPID AND ECONOMICAL TRANSFORMATION OF A WINDOW WITH A WOODEN OR METAL FRAME OR A SINGLE PANE FRAME INTO A WINDOW WITH A PLURALITY OF INSULATING PANES

[76] Inventor: Giovanni Boschetti, 6911 Vezio, Switzerland

[21] Appl. No.: 162,207

[22] Filed: Jun. 23, 1980

[30] Foreign Application Priority Data

Jun. 21, 1979 [CH] Switzerland ..... 5780/79
May 21, 1980 [CH] Switzerland ..... 3945/80

[51] Int. Cl.[3] ..... E06B 1/14

[52] U.S. Cl. ..... 52/741; 52/214; 52/788

[58] Field of Search ..... 52/741, 745, 788, 789, 52/790, 213, 172, 214, 215

[56] References Cited

FOREIGN PATENT DOCUMENTS 2409210 9/1975 Fed. Rep. of Germany ..... 52/616
2654398 6/1978 Fed. Rep. of Germany .
2384094 3/1977 France ..... 52/788
2330841 6/1977 France ..... 52/790
360486 4/1966 Switzerland ..... 52/788

*Primary Examiner*—John E. Murtagh
*Attorney, Agent, or Firm*—Young & Thompson

[57] ABSTRACT

The invention provides for manufacture at another site of a panel of insulating panes having an external, continuous, and self-supporting profile 1-1', without interruption along its periphery.

Into it are cement-fitted two or more spaced panes 2, 3, by means of adhesive 7 and 8, which with polymerizing adhere totally and perfectly both to the periphery of panes 2 and 3 of the panel and to profile 1, 1'.

Because of this, the mounting can be carried out even by a nonexpert person and the construction firm can afford to give all the guarantees.

The insulating panes 1, 2, 3, panel can be applied for example to the wooden assembly 13 of the window of traditional type, leaving the spacers of the preceding pane 14 and the putty 15 which hold it.

3 Claims, 4 Drawing Figures

PROCESS FOR SIMPLE, RAPID AND ECONOMICAL TRANSFORMATION OF A WINDOW WITH A WOODEN OR METAL FRAME OR A SINGLE PANE FRAME INTO A WINDOW WITH A PLURALITY OF INSULATING PANES

The object of the present invention is a process for the simple, rapid and economical transformation of a window with wooden frame, or a window with metal frame, or a single pane frame, into a window or frame with a plurality of insulating panes, or to provide any opening with an insulating glass panel with a plurality of panes.

The difficulties of installation of insulating glass panes have been noted, if double or multiple panes are to be mounted in the prearranged opening of various types of frames.

Generally, this is obtained, with the free external space between the edge of the pane and the rabbet of the frame, with suitable wedges of elastic material, for example neoprene.

The subsequent difficulty is the realization of an impermeable seal between the insulating glass panes and the edges of the frame.

Dilatations caused by sudden changes of temperature and the flexions due to wind pressures frequently allow for infiltration of humidity into the external spaces between the insulating panes and the edges of the frames, and this humidity is also propagated into the interstices between one pane and another with resulting reduction of the life of the insulating glass panes.

These difficulties are also due to the fact that the seal, during the mounting of the insulating panes, is effected with putty, or adhesives which also harden by polymerization and do not ever adhere perfectly to the putty used earlier in the manufacture of the insulating glass panes and which is already polymerized.

The joining between the two putties succeeds only imperfectly and allows the infiltration of the humidity and the formation of pockets of humid air between the two putties which then also propagate to the interstices between one pane and another of the panel itself.

Only mounting by a truly expert worker can partially overcome these defects.

The firms which manufacture insulating glass panels and offer the guarantee of perfect seal against humidity depend upon the ability of the installer, and consequently the guarantees are only held to be valid by said firms if the mounting is effected according to their standards.

This constitutes a grave inconvenience, because the firm which manufactures the insulating glass panels would like to avoid giving the guarantee of hermetic seal if the mounting is not done by one of their installers, while the installers who do not belong to said firm do not wish to assume the responsibility of giving such guarantees.

All of these inconveniences are completely eliminated by the panel of insulating glass panes which is the object of the present invention. According to the invention, the installation can be effected by a non-expert person and then the firm which manufactures the multiple insulating pane panel can give all of the guarantees, whoever carries out the installation.

The process according to the invention is characterized in that a panel with insulating panes, comprising external, self-supporting profile which is continuous along its periphery, is prepared apart from the site wherein the window, the frame or the opening is found, and it permits in and of itself the perfect cement-fitting of a plurality of panes which are spaced from each other in such a manner that the entirety is countersunk with a hermetic seal along all of its sides and for its total spacing in the cement product, and said insulating panes panel can then, at the moment of mounting, be applied to the window, the frame, or the space with all of the guarantees of hermetic seal, even by a person who is not a specialist.

According to one preferred embodiment, the invention provides that the external continuous profile has a rabbet to facilitate the mounting of the insulating panes panel and to cover the spacing of the pane of the window to which the panel is applied, and also the putty which covers said spacing.

The external continuous profile also has an external groove in which is fitted the end of a holding square which is affixed in the window, the frame or the space, during the mounting.

The insulating panes panel according to the invention is characterized by an external, self-supporting profile which is continuous so as to permit, in and of itself, the perfect cement-fitting of the glass panel, constituted of a plurality of panes spaced apart from each other and cemented in in such a manner that the entirety is countersunk with a hermetic seal along all of its sides and through its total spacing in the cementing product.

The attached drawing clearly shows said preferred embodiment of the panel of insulating panes.

Figure 1:
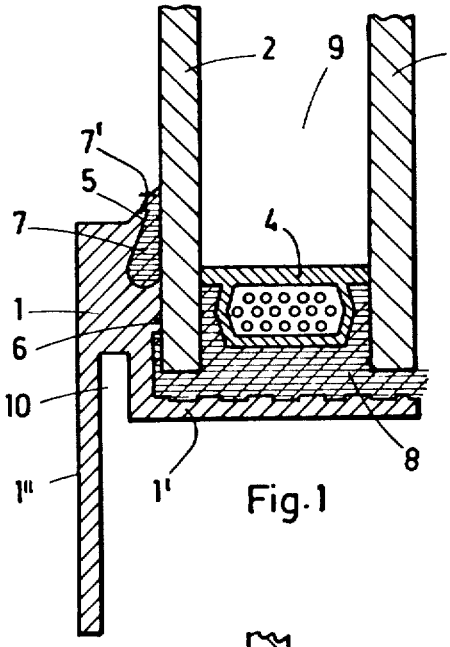
FIG. 1 shows the partial transverse cross section of the panel of insulating panes as it is furnished by the construction firm.
Figure 2:
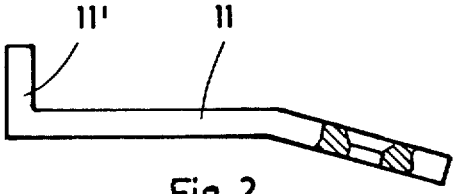
FIG. 2 shows the transverse cross section of a holding square.
Figure 3:
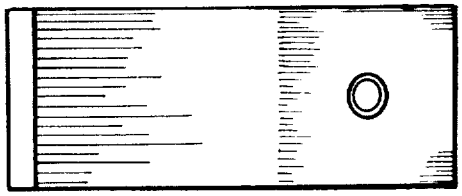
FIG. 3 shows the planar view from above of the square of FIG. 2.

FIG. 1: the insulating panes panel, prepared at another site from the window, the frame or the space to which the panel is to be applied.

It comprises: an external continuous profile 1, i.e. without interruption along its periphery, self-supporting and such as to in and of itself permit the perfect cement-fitting of glass panes 2 and 3. Naturally, the panes can also be of a greater number and can be different from each other.

Between panes 2 and 3 is interposed a spacer 4 of any configuration, containing dehydrant.

It is important to note that profile 1 has the terminal projection 5 drawn back from projection 6, so as to press pane 2 against projection 6, with the adhesive 7 partially removed at 7', assuring the perfect hermetic seal.

In its lower part, profile 1 has square arm 1' which constitutes the external uninterrupted strip and which is cemented in by means of adhesive 8, which by polymerization assures the perfect seal which absolutely prevents the penetration of the humidity into the inside between the two panes 2 and 3.

Space 10 permits the insertion of arm 11' of holding square 11 which is affixed by means of screws 12 to wooden frame 13 of a traditional window with a wooden frame, or to the metallic assembly frame of a window or frame of modern or cemented type at the periphery of the space to which the panel is to be applied.

The side 1'' of profile 1 serves as rabbet and covers the spacing of pane 14 and holding putty 15 of the traditional window to which the insulating panes panel is applied.

The wooden profile 16 is then applied to cover and to protect the panel.

Figure 4:
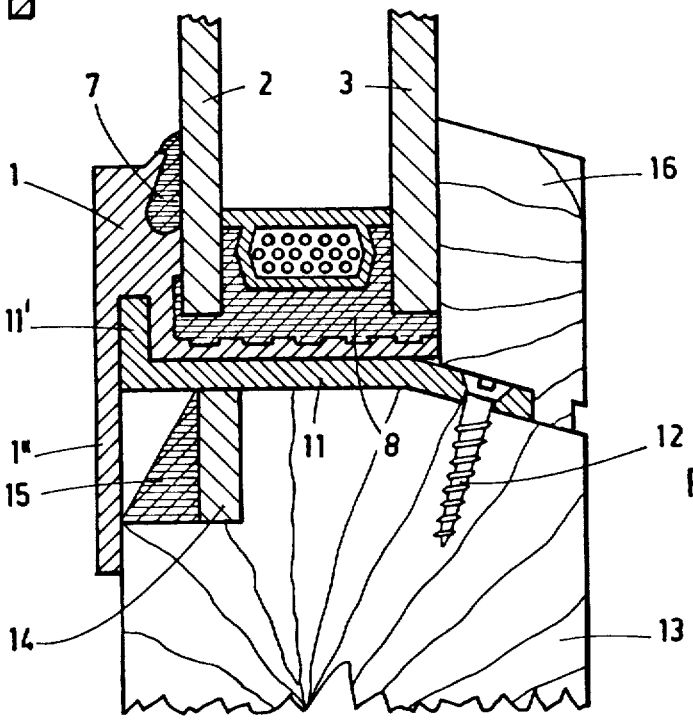
FIG. 4 shows the partial transverse cross section of the panel with insulating panes of FIG. 1 applied to a traditional window with a wooden frame.

As shown in FIG. 4, it is no longer necessary to apply polymerizable putty into the space of the frame during mounting of the insulating panes panel, given that the panel is already seal-cemented to its peripheral assembly. It suffices to lodge the panel in the frame and simply affix squares 11 by means of screws 12.

The result is that even an inexpert installer can apply the insulating panes panel to any window, frame or space without any difficulty.

Thus the construction firm providing the panels of insulating panes can give all the guarantees, without fear, given that the guarantee depends only upon the construction effected during manufacture and not upon the installer.

The shape of the profile, spacers 4, rabbet 1'' and the fixation means can be diverse and the use of the squares 11-11' can vary, and also the panel can be of more than two insulating panes, still within the scope of protection of the patent.

I claim:

1. A process for double glazing openings in a building, comprising prefabricating a double glazed panel with two spaced sheets of glass and a frame having a trim strip and a recess between the trim strip and the frame, transporting the prefabricated glazed panel to a building having an opening to be double glazed, said opening having margins having exposed surfaces, inserting in the recess the upstanding flanges of brackets each of which has an upstanding flange, securing the brackets to the existing margins of said opening, said flanged brackets having end portions extending beyond said frame on the opposite side of said frame from said upstanding flanges, said brackets resting on the exposed surfaces of the margins of the frame, and passing fasteners through said end portions and into said existing margins of said opening.

2. A process during prefabrication of the panel, providing on the frame a flange having a portion which abuts the adjacent said sheet of glass to define recesses between the flange and said adjacent sheet of glass that extend on both sides of said abutting portion, and disposing sealant between said flange and said adjacent sheet of glass in said recesses on both sides of said abutting portion.

3. A process for double glazing openings in a building, comprising prefabricating a double glazed panel with two spaced sheets of glass and a frame having a trim strip and a recess between the trim strip and the frame, transporting the prefabricated glazed panel to a building having an opening to be double glazed, inserting in the recess the upstanding flanges of brackets each of which has an upstanding flange, securing the brackets to the existing margins of said opening, and during prefabrication of the panel, providing on the frame a flange having a portion which abuts the flank of an edge portion of the adjacent said sheet of glass to define recesses between the flange and said adjacent sheet of glass that are disposed on both sides of said abutting portion as seen in a plane perpendicular to the plane of said sheet of glass, and disposing sealant between said flange and said adjacent sheet of glass in said recesses on both sides of said abutting portion.

* * * * *